US011492767B2

(12) United States Patent
Berning et al.

(10) Patent No.: US 11,492,767 B2
(45) Date of Patent: *Nov. 8, 2022

(54) METHOD FOR WORKING GROUND PAVEMENTS, AS WELL AS SELF-PROPELLED CONSTRUCTION MACHINE

(71) Applicant: Wirtgen GmbH, Windhagen (DE)

(72) Inventors: Christian Berning, Zülpich (DE); Andreas Vogt, Asbach (DE); Cyrus Barimani, Königswinter (DE)

(73) Assignee: Wirtgen GmbH

( * ) Notice: Subject to any disclaimer, the term of this patent is extended or adjusted under 35 U.S.C. 154(b) by 21 days.

This patent is subject to a terminal disclaimer.

(21) Appl. No.: 16/665,396

(22) Filed: Oct. 28, 2019

(65) Prior Publication Data

US 2020/0131721 A1 Apr. 30, 2020

Related U.S. Application Data

(63) Continuation of application No. 15/679,349, filed on Aug. 17, 2017, now Pat. No. 10,465,347.

(30) Foreign Application Priority Data

Aug. 29, 2016 (DE) ..... 10 2016 216 216.0

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/00* (2013.01)

(58) Field of Classification Search
CPC ..... E21C 35/24; E21C 27/24; E21C 35/08; E21C 25/06; E21C 25/68; E21C 25/10;
(Continued)

(56) References Cited

U.S. PATENT DOCUMENTS 2,311,891 A 2/1943 Tyson
3,606,742 A 9/1971 Franz et al.
(Continued)

FOREIGN PATENT DOCUMENTS

CA 1266109 A1 2/1990
CN 101078194 A 11/2007
(Continued)

OTHER PUBLICATIONS

China Search Repod for corresponding patent application 201707525288, dated Aug. 28, 2017, 2 pages (not prior art).
(Continued)

*Primary Examiner* — Sunil Singh
(74) *Attorney, Agent, or Firm* — Gary L. Montle; Lucian Wayne Beavers; Patterson Intellectual Property Law, PC

(57) ABSTRACT

In a self-propelled construction machine for working ground pavements comprising at least one machine frame, at least one height-adjustable milling drum for working the ground pavement in a working operation, driven by at least one drive unit, at least one control device for monitoring and controlling the milling depth of the milling drum and the speed of the construction machine, it is provided for the following features to be achieved: that a monitoring device detects an interruption of the working operation, and when detecting the interruption of the working operation emits a signal to interrupt the drive of the milling drum.

18 Claims, 7 Drawing Sheets

(58) Field of Classification Search
CPC ..... E21C 41/00; E21C 35/18; G01F 17/00; E21F 13/025; G01B 21/08; G05D 1/0219; E01C 23/088; E01C 23/09; E01C 23/127
USPC ..... 404/84.05, 90–93; 299/39.1, 39.4
See application file for complete search history.

(56) References Cited

U.S. PATENT DOCUMENTS

| | | | |
|---|---|---|---|
| 3,750,762 | A | 8/1973 | Eaton |
| 4,043,402 | A | 8/1977 | Nelson |
| 4,277,898 | A | 7/1981 | Flippin |
| 4,333,685 | A | 6/1982 | Arnswald |
| 4,343,513 | A | 8/1982 | Godbersen |
| 4,549,610 | A | 10/1985 | Van der Lely |
| 4,588,231 | A | 5/1986 | Silay et al. |
| 4,614,305 | A | 9/1986 | Fekete et al. |
| 4,655,634 | A | 4/1987 | Loy et al. |
| 4,903,780 | A | 2/1990 | Barbieri |
| 4,929,121 | A | 5/1990 | Lent et al. |
| 5,190,398 | A | 3/1993 | Swisher |
| 5,318,378 | A | 6/1994 | Lent |
| 5,415,495 | A | 5/1995 | Johnson |
| 5,879,056 | A | 3/1999 | Breidenbach |
| 6,170,341 | B1 | 1/2001 | Avitan |
| 6,186,248 | B1 | 2/2001 | Silay et al. |
| 6,338,281 | B1 | 1/2002 | El-Ibiary et al. |
| 6,407,475 | B1 | 6/2002 | Care |
| 6,558,072 | B2 | 5/2003 | Staffenhagen et al. |
| 6,921,230 | B2 | 7/2005 | Silay |
| 7,422,391 | B2 | 9/2008 | Holl et al. |
| 7,530,641 | B2 | 5/2009 | Berning et al. |
| 7,905,682 | B2 | 3/2011 | Holl et al. |
| 7,984,953 | B2 | 7/2011 | Gaertner et al. |
| 8,128,177 | B2 | 3/2012 | Menzenbach et al. |
| 8,292,371 | B2 | 10/2012 | Menzenbach et al. |
| 8,408,838 | B2 | 4/2013 | Willis et al. |
| 8,465,105 | B2 | 6/2013 | Parker et al. |
| 8,632,132 | B2 | 1/2014 | Wenzenbach et al. |
| 8,668,274 | B2 | 3/2014 | Gaertner et al. |
| 8,888,194 | B2 | 11/2014 | Killion |
| 8,998,344 | B2 | 4/2015 | Berning et al. |
| 9,644,330 | B2 | 5/2017 | Berning et al. |
| 10,465,347 | B2 * | 11/2019 | Berning et al. |
| 2007/0286678 | A1 | 12/2007 | Berning et al. |
| 2008/0173740 | A1 | 7/2008 | Parker et al. |
| 2011/0266858 | A1 | 11/2011 | Laux et al. |
| 2014/0191560 | A1 | 7/2014 | Gaertner et al. |
| 2014/0348585 | A1 | 11/2014 | Nacke et al. |
| 2015/0227120 | A1 | 8/2015 | Laux et al. |
| 2015/0252539 | A1 | 9/2015 | Berning et al. |
| 2016/0356004 | A1 | 12/2016 | Berning et al. |
| 2017/0233959 | A1 | 8/2017 | Berning et al. |

FOREIGN PATENT DOCUMENTS

| | | | |
|---|---|---|---|
| CN | 102644232 | A | 8/2012 |
| DE | 10203732 | A1 | 8/2003 |
| DE | 10213017 | A1 | 10/2003 |
| DE | 102006024123 | A1 | 11/2007 |
| DE | 112008000646 | T5 | 5/2010 |
| DE | 102014001885 | A1 | 8/2015 |
| DE | 102015002426 | A1 | 6/2016 |
| EP | 2354310 | A2 | 8/2011 |
| EP | 2722441 | A1 | 4/2014 |
| EP | 2840183 | A1 | 2/2015 |
| EP | 3208382 | A1 | 8/2017 |
| WO | 03064770 | A1 | 8/2003 |
| WO | 2016102410 | A1 | 6/2016 |

OTHER PUBLICATIONS

European Search Repod for corresponding European Patent application 17 17 8919 dated Jan. 8, 2018, 3 pp. (not prior art).
International Search Report in corresponding International Patent Application No. PCT/EP2015/080699 dated Feb. 15, 2016, 10 pp. (not prior art).
Brochure re Model DA 120 available from ME-Messysteme GmbH of Hennigsdorf, Germany, (undated but admitted to be prior art).

* cited by examiner

METHOD FOR WORKING GROUND PAVEMENTS, AS WELL AS SELF-PROPELLED CONSTRUCTION MACHINE

BACKGROUND OF THE INVENTION

The invention relates to a method for working ground pavements, as well as to a self-propelled construction machine, specifically a road milling machine, soil stabilizer, recycler or surface miner.

Self-propelled construction machines for working ground pavements are known, for example, from DE 10 2006 024 123 B4. The self-propelled construction machine described therein comprises a machine frame, as well as a height-adjustable milling drum for working a ground pavement. The milling drum is driven by a drive unit. Such construction machine comprises a control device for monitoring and controlling the milling depth of the milling drum and the speed of the construction machine.

With such construction machines, it is known, for example, that the drive unit drives the milling drum via a power transmission drive, and the drive of the milling drum can be shifted via a, for example, mechanical coupling.

It may, however, also be specified for the milling drum to be driven by means of hydraulic motors or electric motors.

Now there is an increasing requirement, however, to save energy and fuel during the working of ground pavements, thus enabling a more environmentally friendly operation.

BRIEF SUMMARY OF THE INVENTION

It is therefore the object of the invention to create a construction machine, as well as a method for working ground pavements by means of which the operation is optimized.

The aforementioned object is achieved by the features of the independent claims.

The invention advantageously specifies for an interruption of the working operation to be detected, and for the drive of the milling drum to be interrupted in the event of a detected interruption of the working operation.

Detection of the interruption of the working operation, and the interruption of the drive of the milling drum are effected automatically.

The present invention offers the advantage that the milling drum is not driven when the same is not in working operation, and the energy consumption of the construction machine is consequently reduced.

According to the present invention, the milling drum is in working operation when the construction machine is working the ground, that is, when the construction machine is moving forward and the milling drum is rotating and is engaged with the ground.

To detect the interruption of the working operation, at least one operating parameter of the construction machine can be monitored.

The at least one operating parameter of the construction machine which can be monitored to detect the interruption of the working operation may specifically be an actual operating parameter of the construction machine. An actual operating parameter is an operating parameter which reflects the current condition of the construction machine. The operating parameters which indicate as to whether the construction machine is stationary and/or the milling drum is engaged with the ground pavement are of particular relevance.

Engagement with the ground pavement means that the milling drum is in contact with the ground pavement and can work the same in this position.

When detecting the interruption of the working operation, the at least one operating parameter, specifically the at least one actual operating parameter, may be compared with at least one specified limit value.

The at least one operating parameter which can be monitored to detect the interruption of the working operation may be the actual milling depth and/or the actual speed.

The actual milling depth can be used to monitor as to whether the milling drum is engaged with the ground pavement. The actual milling depth shows a positive value when the milling drum is engaged with the ground pavement, and when the milling drum is raised and therefore exhibits a distance to the ground pavement, the milling depth shows a negative amount.

If the actual speed of the construction machine is monitored as an operating parameter, an interruption of the working operation can be detected when the actual speed of the construction machine is zero. This means that the working operation is interrupted when the construction machine is stationary.

The speed input device of the construction machine and/or the movement of the travelling devices and/or the hydraulic pressure of the running gear motors driving the travelling devices can be monitored in order to monitor the actual speed of the construction machine.

The construction machine comprises travelling devices by means of which the construction machine can travel over the ground pavement. The travelling devices may be wheels or tracked ground-engaging units which are connected to the machine frame via lifting columns. The travelling devices are preferably driven via hydraulic motors.

The actual speed of the construction machine can be monitored by monitoring the nominal speed at the speed input device. Provided that the nominal speed of the construction machine is zero, the actual speed is typically also zero since the construction machine does not comprise a rolling operation so that the construction machine comes to a standstill immediately as soon as the nominal speed is zero.

When interrupting the drive of the milling drum, the milling drum may be decoupled from the drive unit, and/or the drive unit may be switched off in case of an electric or hydraulic drive unit.

After the interruption of the working operation has been detected, the interruption of the working operation of the milling drum may take place only after a specified time delay.

After the drive of the milling drum has been interrupted, it can be detected as to whether the working operation is to be continued, in which case, when detecting the intended continuation of the working operation, the milling drum is driven again.

The detection of the intended continuation of the working operation and the renewed driving of the milling drum are effected automatically.

It is crucial in this context that the working operation has not yet started but that the continuation of the working operation is detected prior to the same being started as it must be ensured that the milling drum has reached the operating speed of revolution again prior to continuing the working operation.

To detect the intended continuation of the working operation, at least one operating parameter of the construction machine can be monitored. The at least one operating parameter which is monitored to detect the intended continuation of the working operation may specifically be a nominal operating parameter of the construction machine. A nominal operating parameter is an operating parameter which reflects a condition of the construction machine preadjusted by the operator. The operating parameter which is monitored to detect the intended continuation of the working operation may particularly preferably be the nominal speed of the construction machine and/or the nominal milling depth and/or the actual milling depth.

An intended continuation of the working operation can be detected when the nominal speed of the construction machine is greater than zero, no reversing operation is detected, and the nominal milling depth exceeds a specified limit value.

In this context, the limit value for the nominal milling depth may, for example, be zero. The limit value must be selected so as to ensure that a detection of the intended continuation of the working operation is effected when a nominal milling depth is adjusted at which the milling drum, when the same reaches the nominal milling depth, is able to engage with the ground. A certain degree of safety may be taken into account in this process when selecting the limit value.

Provided that, when the milling drum is not driven, the milling drum is not engaged with the ground pavement, detection of the intended continuation of the working operation can only be effected as a function of the nominal milling depth provided that no reversing operation is detected.

The movement of the construction machine and/or a lowering of the milling drum can be delayed for such a period of time that the milling drum has reached a specified operating speed of revolution. In this way, it is ensured that the milling drum has reached an operating speed of revolution when contact is made between the milling drum and the ground pavement. In the process, either the speed of revolution of the milling drum can be detected directly via, for example, a sensor, or the resumption of the milling operation can be delayed for a certain period of time after the milling drum is driven again in order to ensure that the milling drum has reached the operating speed of revolution again.

After the detection of an interruption of the working operation, the milling drum may be raised by a specified amount, in particular if the interruption of the working operation is effected because the actual speed is zero. This also ensures that, when the milling drum is driven again, the milling drum is not in contact with the ground pavement until the milling drum has reached an operating speed of revolution.

Following the detection of the continuation of the working operation, the milling drum can be driven again and then lowered.

While the milling drum is not driven, a visual or audible signal, for example, may indicate that the milling operation was interrupted automatically. In this way, it is ensured that the operator and/or personnel in the environment of the construction machine are aware at any time that the milling drum can be switched on automatically when the working operation is to be continued.

It may be specified for the construction machine to assume a defined position (or a position range) relative to the ground pavement prior to the milling drum being driven again. If, for example, the machine frame is raised to the maximum height via the lifting columns, parts of the milling drum may be exposed which may lead to any material present in the milling drum casing being hurled out of the same if the milling drum is driven at that moment. Prior to the milling drum being driven again, a defined milling depth may therefore be adjusted automatically, for example, at which the milling drum does not yet engage with the ground pavement but an escape of material from the milling drum housing is excluded.

Alternatively/Additionally, it can be checked prior to the milling drum being driven again as to whether edge protection, hold-down device and scraper are resting on the ground, meaning that the milling drum housing is closed towards the outside.

The power output of the drive unit, for example, the speed of revolution of a motor used as a drive unit, may be reduced following the interruption of the drive of the milling drum. It is increased again accordingly prior to driving the milling drum again.

Following the interruption of the drive of the milling drum, it may be specified for the same to continue rotating due to inertia. Alternatively, it may also be specified for it being braked, for example, in order to recover the energy of rotation for an energy storage device. The energy could be stored and then utilized when the milling drum is switched on again.

The automated process of detecting the interruption of the working operation, interrupting the drive of the milling drum, detecting the continuation of the working operation and driving the milling drum again can be activated/deactivated by the operator.

In accordance with the present invention, a self-propelled construction machine for working ground pavements comprising at least one machine frame, at least one height-adjustable milling drum for working the ground pavement in a working operation, driven by at least one drive unit, at least one control device for monitoring and controlling the milling depth of the milling drum and the speed of the construction machine, is specified in which a monitoring device detects an interruption of the working operation, and when detecting the interruption of the working operation emits a signal to interrupt the drive of the milling drum.

The self-propelled construction machine may also comprise travelling devices, where the travelling devices may comprise wheels or tracked ground-engaging units which may be connected to the machine frame in a height-adjustable fashion via lifting columns. The height adjustment of the lifting columns may be effected, for example, via hydraulic piston-cylinder units. Furthermore, the drive unit may specifically be a drive motor.

Furthermore, the self-propelled construction machine may comprise one or multiple operating devices which comprise no less than one speed input device and one milling depth input device.

The milling drum may be accommodated in a milling drum housing. The milling drum housing may comprise a left and a right edge protector at the end sides, a hold-down device at the front side and a scraper at the rear side, where the same close the working chamber of the milling drum towards the outside. The construction machine may also comprise front and rear drum plates to seal off the working chamber.

The milling drum may be mounted in the machine frame. The milling drum may be directly connected to the machine frame. Regulation of the milling depth can then be effected by means of a height adjustment of the lifting columns which connect the ground-engaging units of the construction machine with the machine frame. Alternatively or additionally, the milling drum may be adjustable in height relative to the machine frame.

The feature according to which the monitoring device detects the interruption of the working operation, and when detecting the interruption emits a signal to interrupt the drive of the milling drum, may be an additional feature which may be capable of being switched on or switched off.

The monitoring device can monitor at least one operating parameter of the construction machine to detect the interruption of the working operation.

The at least one operating parameter of the construction machine which is monitored to detect the interruption of the working operation may be an actual operating parameter, specifically the actual speed of the construction machine and/or the actual milling depth.

In order to monitor the at least one operating parameter of the construction machine, the monitoring device may query the at least one operating parameter of the construction machine from the control device and/or from sensors and compare the at least one operating parameter queried with at least one specified limit value. The at least one specified limit value may be stored in the monitoring device. The at least one specified limit value may be determined by means of tests.

The monitoring device may detect an interruption of the working operation and emit a signal to interrupt the drive of the milling drum when the actual speed of the construction machine is zero.

This means that the working operation is interrupted when the construction machine is stationary.

The construction machine may comprise a power transmission device for transmitting a driving power from a drive unit to the milling drum. The monitoring device can emit the signal to interrupt the drive of the milling drum to the power transmission device or to the control device, and the power transmission device can interrupt the drive of the milling drum.

The power transmission device may comprise a coupling to this effect so that the milling drum is decoupled from the drive unit when a signal to interrupt the drive is emitted to the power transmission device.

The monitoring device may detect an interruption of the working operation and emit the signal to interrupt the drive of the milling drum when the actual milling depth of the construction machine falls below a limit value.

The monitoring device may detect an interruption of the working operation and emit the signal to interrupt the drive of the milling drum only after a specified time delay.

Following the interruption of the drive of the milling drum, the monitoring device may detect as to whether the working operation is to be continued, and when detecting the intended continuation of the working operation, may emit a second signal for the renewed driving of the milling drum.

It is crucial in this regard that the intended start of the working operation is detected when driving the milling drum again. It must be ensured that the milling drum is already driven prior to starting the working operation.

In order to detect the intended continuation of the working operation, the monitoring device may query the at least one operating parameter of the construction machine from the control device and/or an operating device and/or from sensors measuring the at least one operating parameter, and compare the at least one operating parameter with at least one specified limit value. The at least one specified limit value may be stored in the monitoring device or the control device. The at least one specified limit value may be determined by means of tests.

The at least one operating parameter which the monitoring device monitors to detect the intended continuation of the working operation is specifically a nominal operating parameter as the intended continuation of the working operation is to be already detected. The nominal operating parameters are specified operating parameters of the construction machine. These may be, for example, the operating parameters entered at the operating device.

The at least one operating parameter which is to be monitored to detect the intended continuation of the working operation may specifically be the nominal speed and/or nominal milling depth and/or the actual milling depth.

The nominal speed and/or the nominal milling depth may specifically be the values entered at the speed input device and/or the milling depth input device of the operating device.

The actual speed may be determined via sensors which measure the movement and/or the position of the travelling devices and/or the hydraulic pressure of the running gear motors driving the travelling devices.

The actual milling depth may be determined via sensors which are arranged in or at the height adjustment feature. In this arrangement, the height adjustment feature may be the lifting columns of the construction machine. Furthermore, to measure the actual milling depth, the sensors may also measure the distance between the machine frame and the ground surface. The sensors may also be arranged at a scraper blade arranged behind the milling drum or at side plates surrounding the milling drum. Sensors of any other kind may also be specified which are able to determine the milling depth.

The monitoring device may be part of the control device. The operating device may also be part of the control device.

BRIEF DESCRIPTION OF THE DRAWINGS

Hereinafter, embodiments of the invention are illustrated in more detail with reference to the drawings.

The following is shown schematically.

DETAILED DESCRIPTION OF THE INVENTION

Figure 1:
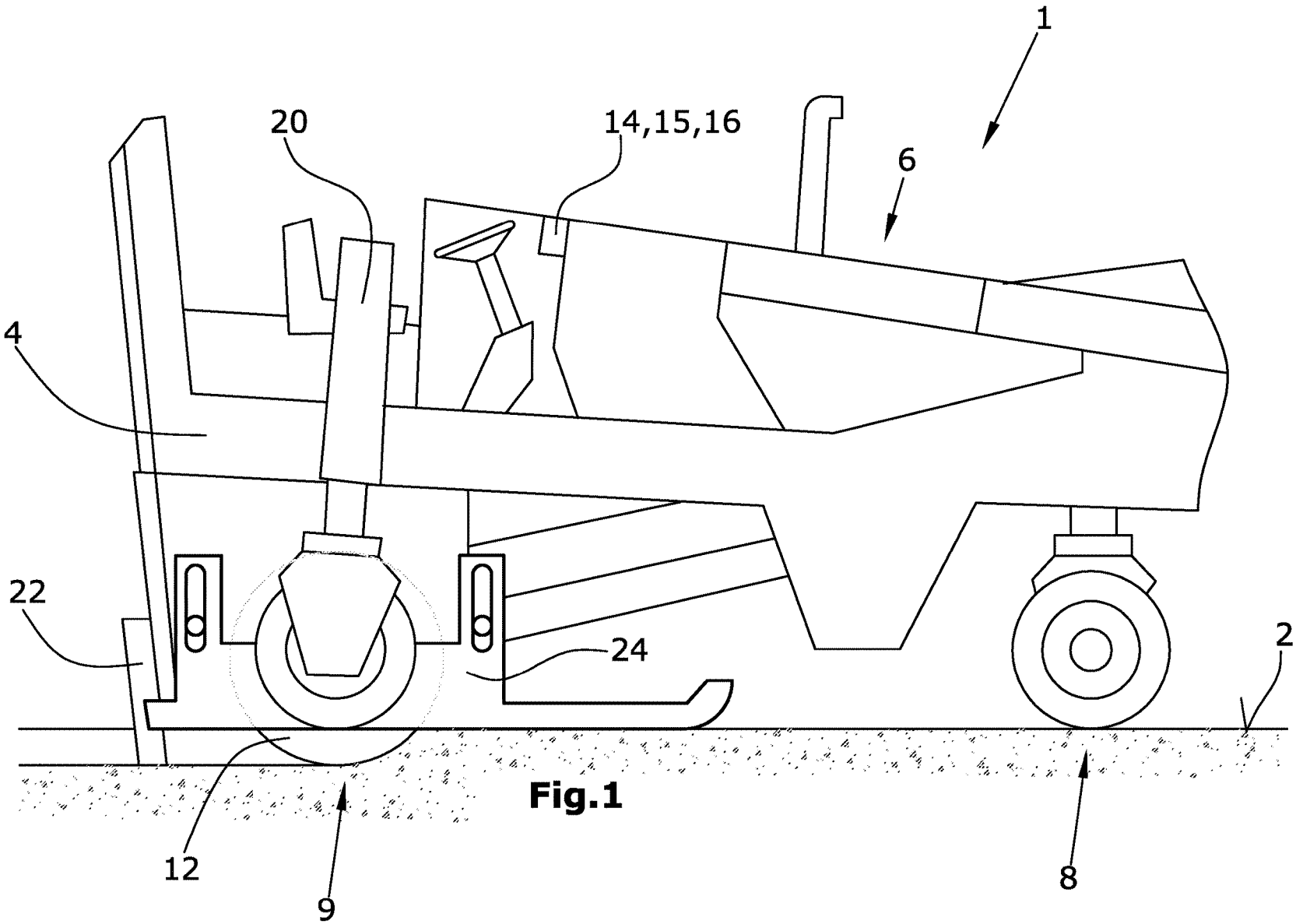
FIG. 1 shows a self-propelled construction machine for working ground pavements.

FIG. 1 shows a self-propelled construction machine 1 for working ground pavements 2. The construction machine 1 comprises, as a minimum, a machine frame 4. Furthermore, the construction machine comprises a height-adjustable milling drum 12 for working the ground pavement 2 where, in a working operation, the milling drum 12 works the ground pavement 2. The milling drum 12 may be accommodated in a milling drum housing. The milling drum housing may comprise a left and a right edge protector 24 at the end sides, a hold-down device at the front side and a scraper 22 at the rear side, where the same close the working chamber of the milling drum 12 towards the outside.

Figure 2:
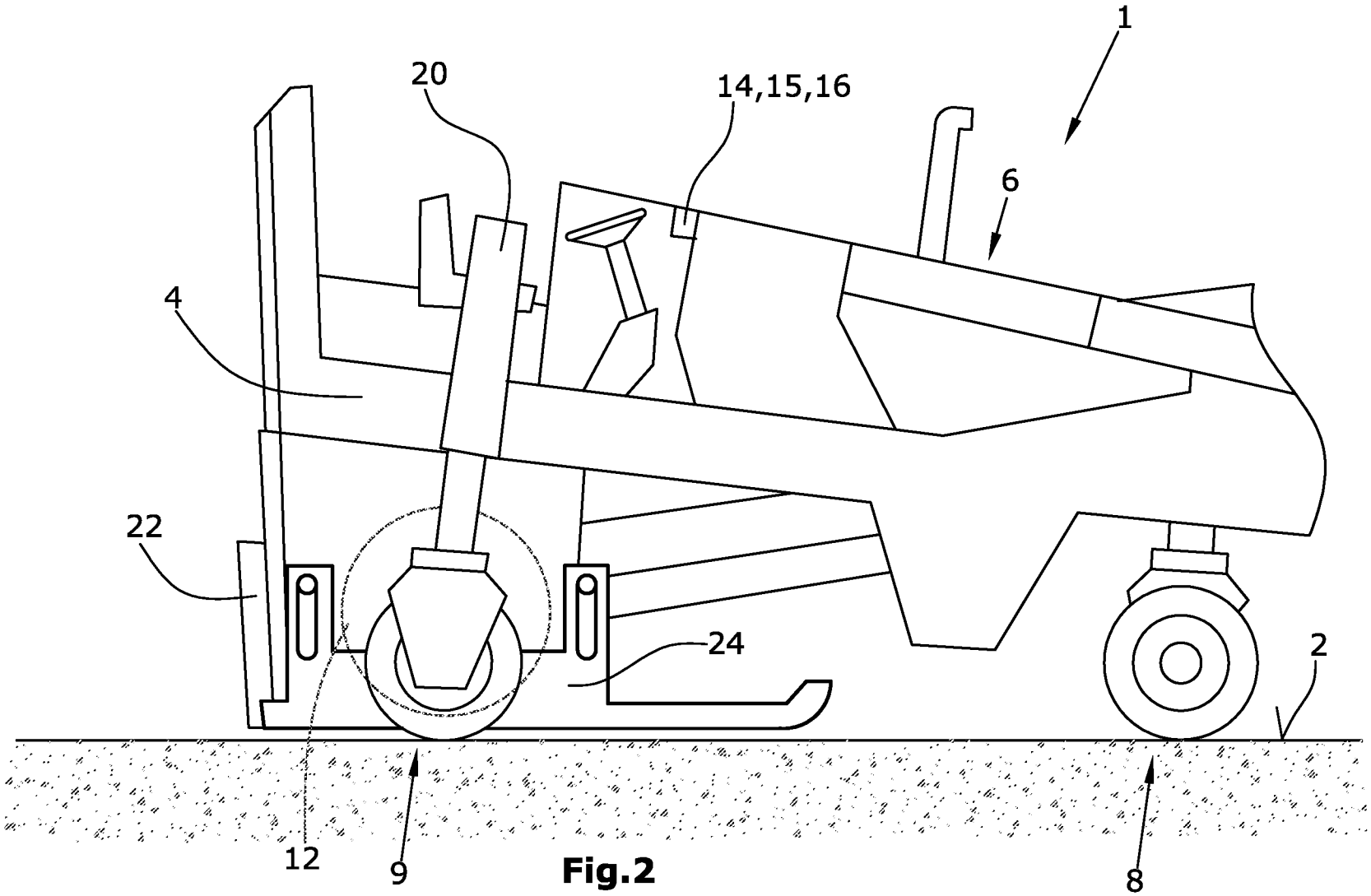
FIG. 2 shows the construction machine according to FIG. 1 with raised milling drum.

Furthermore, the construction machine 1 comprises a control device 14 for monitoring and controlling the milling depth of the milling drum 12 and the speed of the construction machine 1. The milling drum 12 is driven by a drive unit 6. The drive unit 6 is preferably a drive motor, specifically, a combustion engine. Alternatively, the drive unit may also be an electric or hydraulic motor. The construction machine 1 furthermore comprises front and rear travelling devices 8, 9. Said travelling devices 8, 9 may be wheels or tracked ground-engaging units. The rear travelling devices 9 are connected to the machine frame 4 in a height-adjustable fashion via lifting columns 20 by means of, for example, piston-cylinder units. The front travelling device 8 is also connected to the machine frame 4. The front travelling devices 8 may, in a different fashion than depicted, also be connected to the machine frame via lifting columns. The construction machine 1 or the machine frame 4, respectively, can be adjusted in height relative to the ground pavement by means of the lifting columns 20. The machine frame 4 is adjusted in height by adjusting the lifting columns 20, and as a result, the milling drum 12 mounted in the machine frame 4 is adjusted in height as well. In FIG. 2, the construction machine 1 is depicted with the milling drum 12 raised. Alternatively or additionally, the milling drum may be adjustable in height relative to the machine frame.

In a method for working the ground pavement 2, an interruption of the working operation is detected, and the drive of the milling drum 12 is interrupted in the event of a detected interruption of the working operation. In this arrangement, the monitoring device 15 detects an interruption of the working operation, and when detecting the interruption of the working operation, the monitoring device 15 emits a signal to interrupt the drive of the milling drum 12.

The monitoring device 15 monitors operating parameters of the construction machine 1 to detect the interruption of the working operation. The operating parameters are compared with specified limit values which may be stored in the monitoring device.

The operating parameters which are monitored to detect the interruption of the working operation may specifically be the actual speed of the construction machine 1 and/or the actual milling depth.

Provided that the actual speed of the construction machine 1 is zero, the working operation is interrupted. Furthermore, the working operation is also interrupted when the milling drum 12 is no longer engaged with the ground pavement 2. This is the case, for example, in FIG. 2. There, the milling drum 12 is no longer engaged with the ground pavement 2. In this case, the working operation is interrupted.

When detecting the interruption of the working operation, the drive of the milling drum 12 is interrupted.

Figure 3:
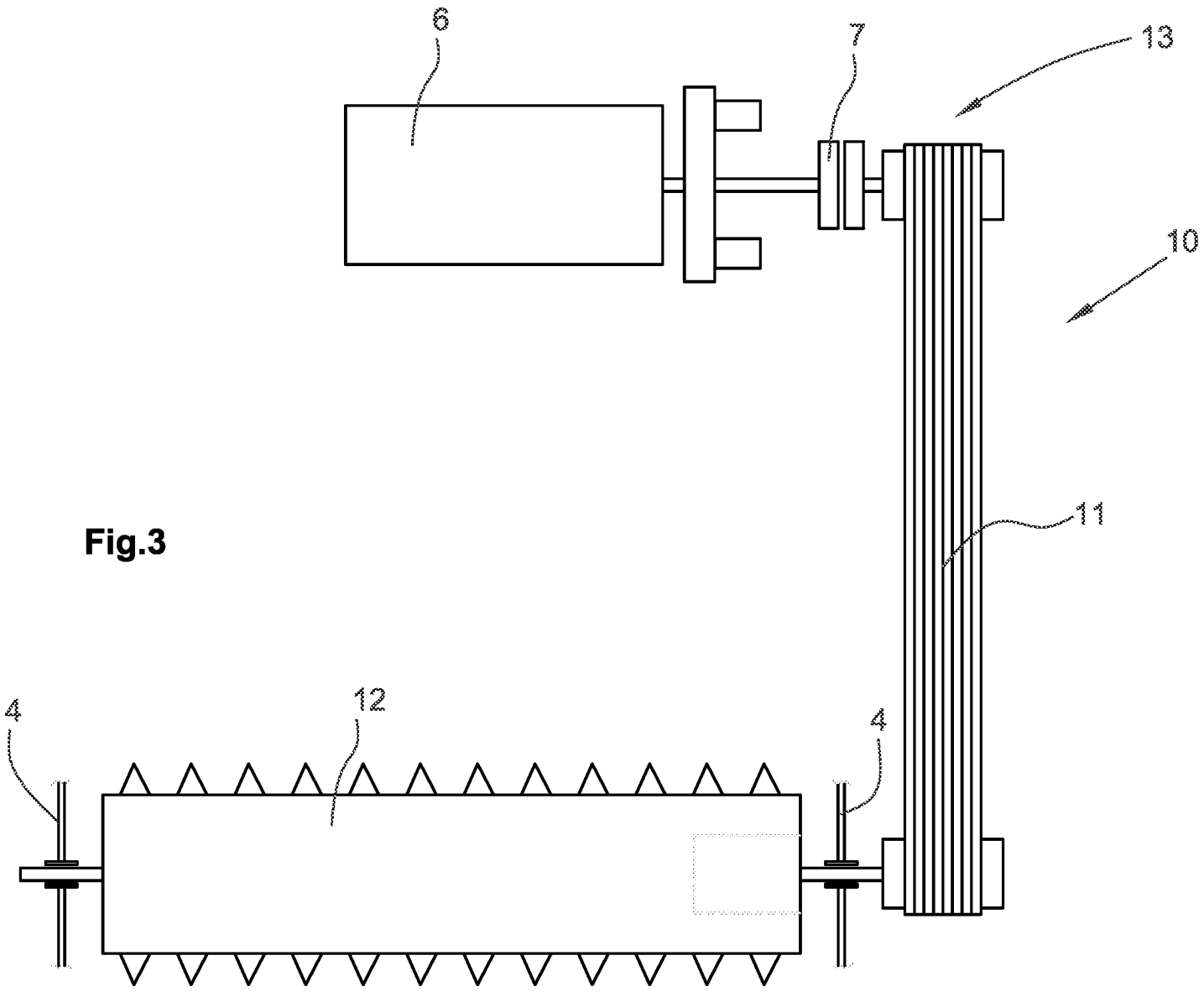
FIG. 3 shows a power train of the construction machine.

The power train of the construction machine 1 is depicted in FIG. 3. In this arrangement, the driving power is transmitted, via a drive unit 6 which is preferably a drive motor, specifically a combustion engine, to the milling drum 12 via a power transmission device 13. The power transmission device comprises a coupling 7 and a drum drive 10. The drum drive 10 drives the milling drum 12 by means of a belt drive 11.

In case of an interrupted working operation, a signal is emitted to the power transmission device which interrupts the drive of the milling drum 12. In the process, the drive unit 6 is decoupled from the milling drum 12 by means of the coupling 7.

Figure 4:
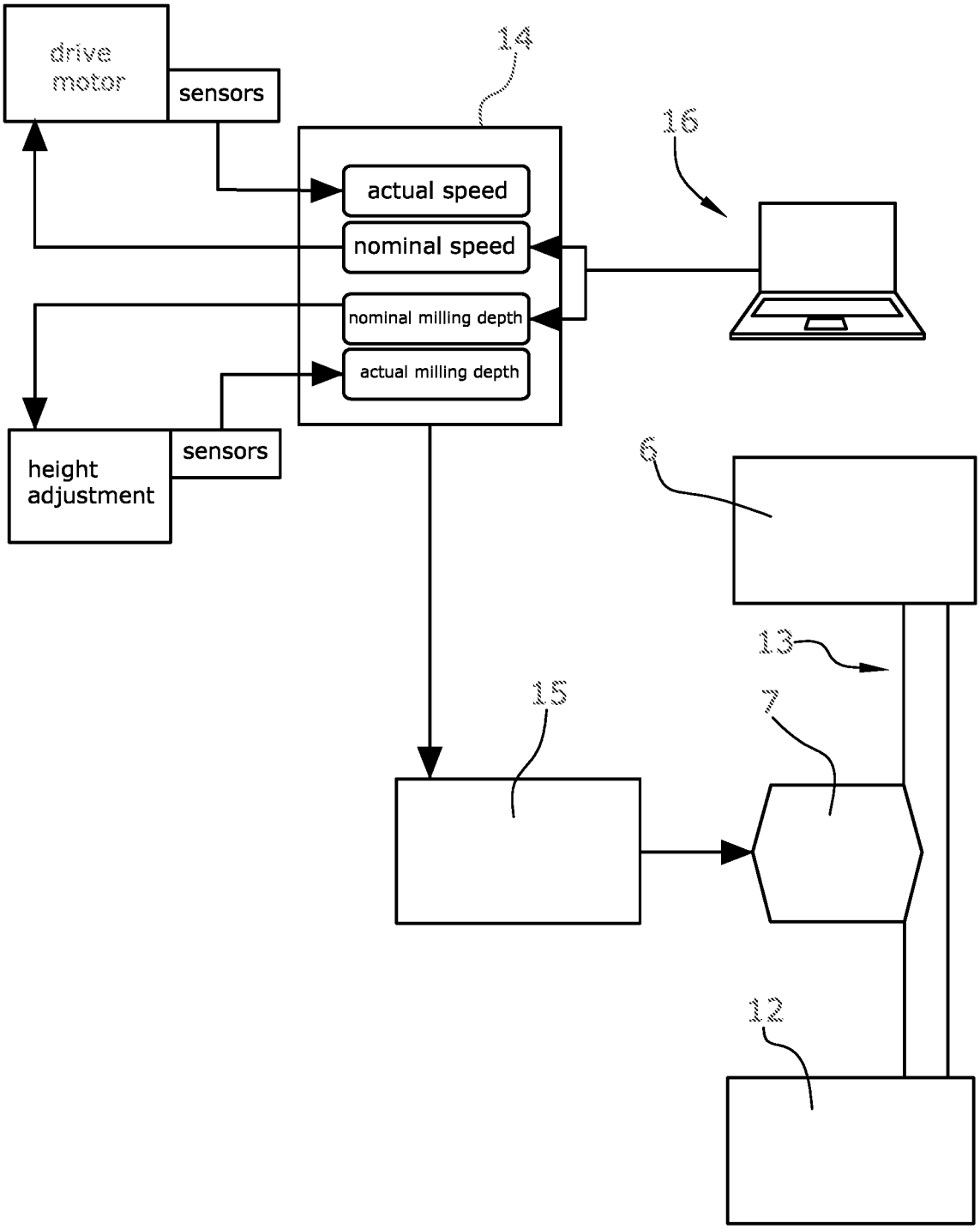
FIG. 4 shows an illustration showing the control device and monitoring device.

In FIG. 4, an illustration is depicted which depicts the signal paths between the control device 14, monitoring device 15, operating device 16, travel drive, height adjustment, drive unit 6 and milling drum 12. The monitoring device 15 monitors operating parameters of the construction machine to detect the interruption of the working operation.

It is depicted in FIG. 4 that the monitoring device queries the operating parameters from the control device 14. In the embodiment depicted, the operating parameters which can be queried from the control device 14 are, among other things, the actual speed, the nominal speed, the nominal milling depth and the actual milling depth.

The monitoring device 15 compares the operating parameters queried with specified limit values. The actual operating parameters are queried specifically to detect the interruption of the working operation. The actual speed, which is referred to as actual advance rate, and/or the actual milling depth are thus specifically queried by the monitoring device 15 and compared with specified limit values.

The control unit receives measuring data from sensors about the actual speed and the actual milling depth. The sensors for determining the actual speed may be arranged at parts of the travel drive. The travel drive comprises the travelling devices and running gear motors for driving the travelling devices, where one running gear motor is preferably assigned to each travelling device. The running gear motors may be hydraulic motors and may be driven by a common hydraulic variable displacement pump.

Sensors of any other kind may also be used, however, which are able to determine the actual speed of the construction machine 1.

The actual milling depth is detected by sensors which are arranged at the height adjustment feature, for example, at the lifting columns or at the piston-cylinder units. The sensors may also be arranged in any other position, however, provided that the same are able to determine the actual milling depth. They may be arranged, for example, at the scraper blade 22 and/or at the side plates 24. Further sensors for determining the milling depth, such as ultrasonic sensors, are known to the person skilled in the art. The exact procedure to determine the milling depth is not relevant to the invention; it must merely be ensured that one can be detected reliably when the milling drum is disengaged from the ground surface in order to detect an interruption of the working operation.

Provided that the monitoring device determines, by comparison of the operating parameters with specified limit values, that the working operation is interrupted, the monitoring device emits a signal to the power transmission device 13. The power transmission device 13 comprises means for interrupting the flux of power.

The means for interrupting the flux of power is preferably a coupling as it is depicted in FIG. 3.

The drive of the milling drum is interrupted with the aid of the means for interrupting the flux of power. Provided that the means for interrupting the flux of power is a coupling 7, the milling drum 12 is decoupled from the drive unit 6 in case of an interrupted working operation.

After the drive of the milling drum 12 has been interrupted, it is detected as to whether the working operation is to be continued. When detecting the intended continuation of the working operation, the milling drum 12 is driven again. To this effect, the monitoring device 15, following the interruption of the drive of the milling drum 12, detects as to whether the working operation is to be continued, and when detecting the intended continuation of the working operation, emits a second signal for the renewed driving of the milling drum 12. In this process, the monitoring device 15 emits the second signal for the renewed driving of the milling drum 12 specifically to the power transmission device 13.

In order to detect the intended continuation of the working operation, the monitoring device 15 queries operating parameters from the control device 14 and compares the queried operating parameters with specified limit values which may be stored in the monitoring device 15. In this arrangement, the nominal operating parameters are specifically queried to detect the intended continuation of the working operation. The nominal speed and the nominal milling depth are preferably queried in this process. These may be queried from the control device and/or the operating device.

Figure 5:
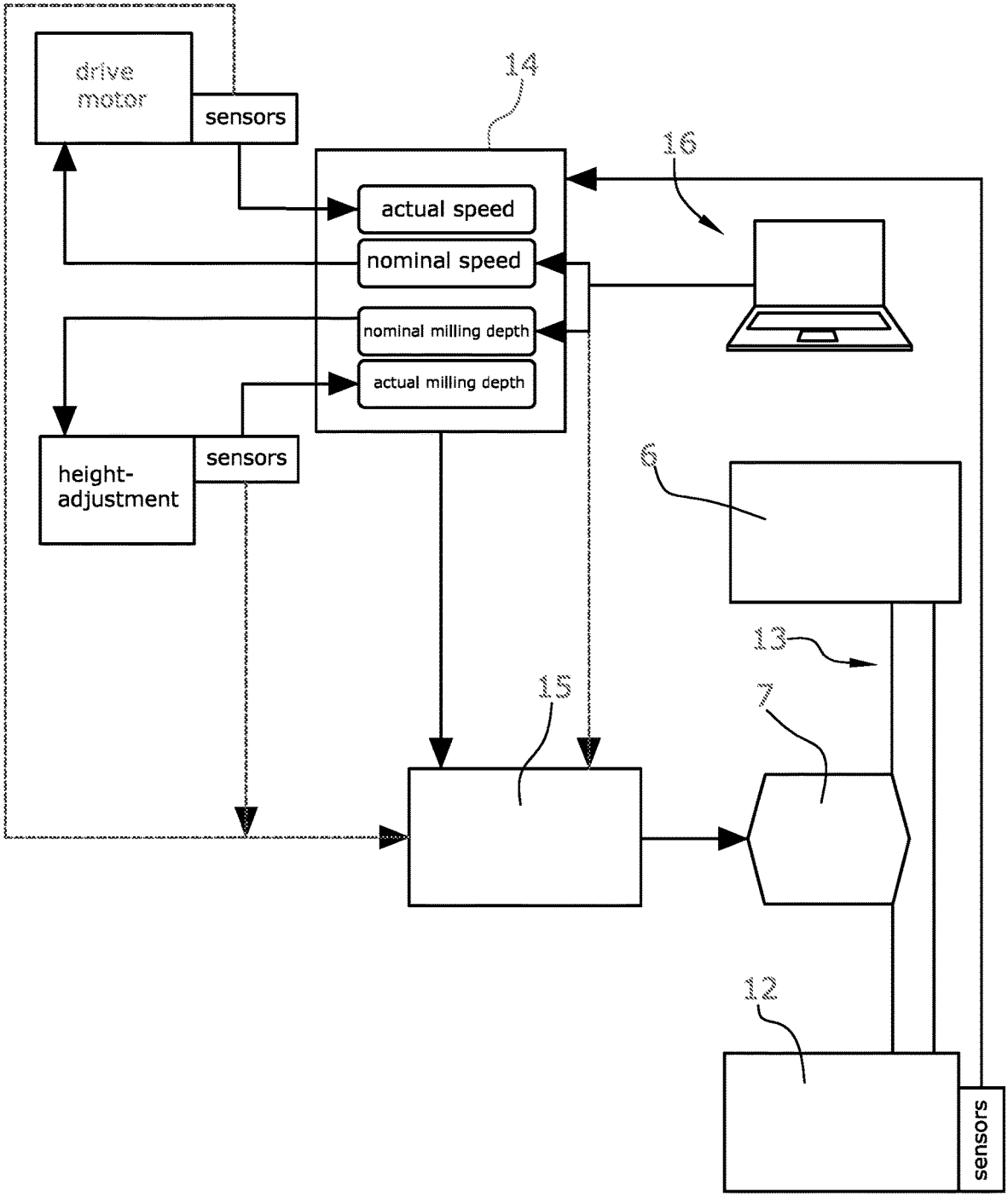
FIG. 5 shows an alternative illustration.

It is depicted in FIG. 5 that the monitoring device 15 may also query the operating parameters directly from the sensors or directly from the operating device 16, respectively.

The monitoring device 15 may detect an interruption of the working operation and emit the signal to interrupt the drive of the milling drum only after a specified time delay.

The monitoring device 15 may also delay the movement of the construction machine 1 and/or a lowering of the milling drum 12 until the milling drum 12 has reached a specified operating speed of revolution again. It is further depicted in FIG. 5 that sensors may also be arranged at the milling drum 12 which measure the speed of revolution of the milling drum 12. To this effect, the monitoring device 15 may query the operating speed of revolution determined by a sensor from the control unit or directly from the sensors.

The milling drum 12 may also be raised after detection of an interruption of the working operation.

After detection of the intended continuation of the working operation, the milling drum 12 may then be driven again and then be lowered. In this way, it is ensured that the milling drum 12 is in contact with the ground pavement 2 only when the milling drum 12 has reached an operating speed of revolution.

Figure 6:
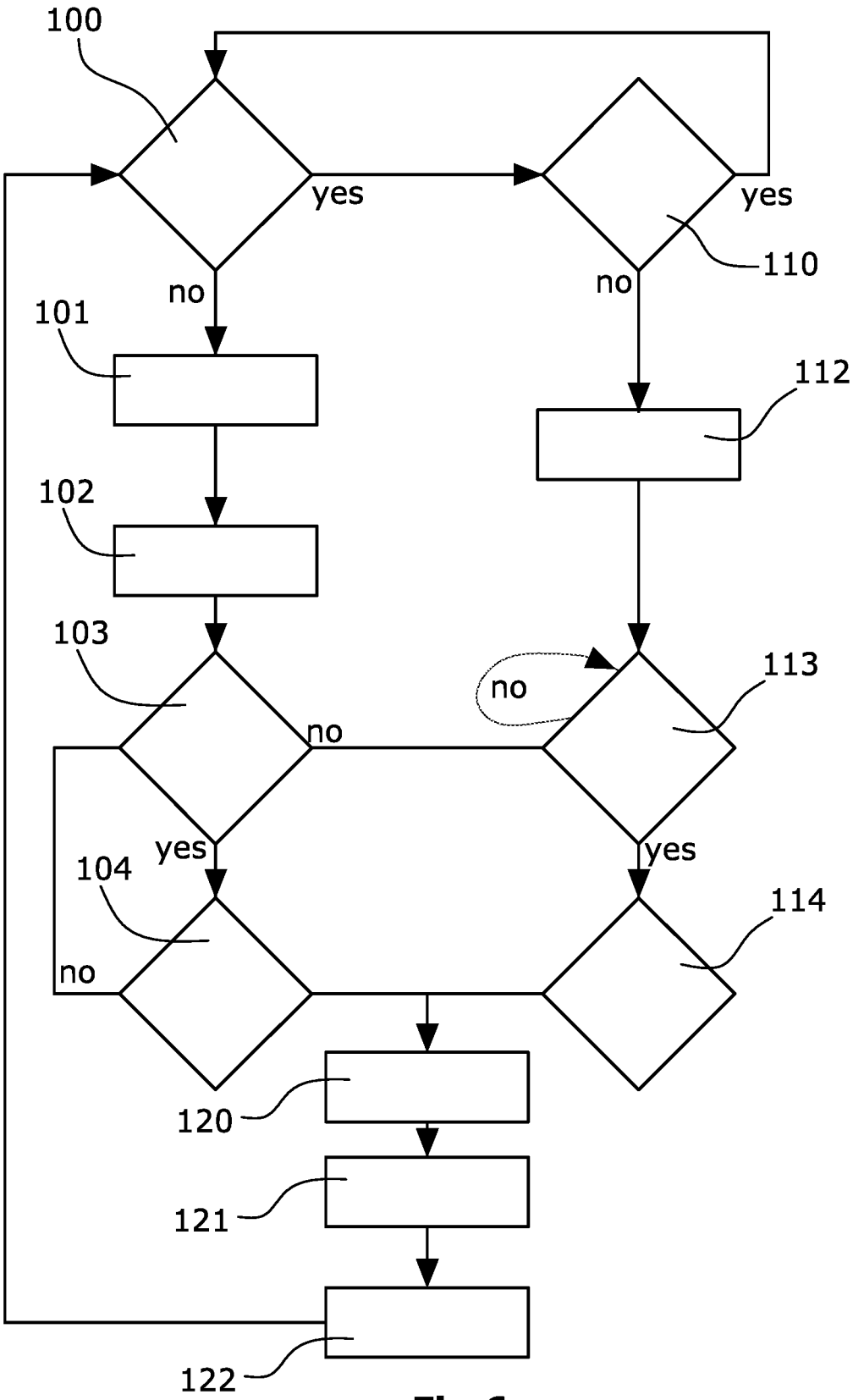
FIG. 6 shows a flow diagram for detecting the interruption and the intended continuation of the working operation.

FIG. 6 shows a flow diagram for detecting the interruption of the working operation and the intended continuation of the working operation.

In order to detect the interruption of the working operation, the nominal speed of the milling machine queried from the control device 14 or from sensors is compared with a limit value in block 100 specifically to determine as to whether the advance rate, that is, the speed of the construction machine 1 is greater than 0.

If the speed is greater than zero, the actual milling depth determined from the control device 14 or from sensors is compared with a limit value in a subsequent step in block 110, it being specifically determined as to whether the milling drum 12 is engaged with the ground at the adjusted milling depth.

If it is determined in block 100 that the actual speed is zero, an interruption of the working operation is detected. Following detection of the interruption of the working operation, the milling drum may be raised by a specified amount as depicted in block 101. The drive of the milling drum is then interrupted in block 102.

In the following, the nominal milling depth, which may also be queried from the control unit 14 or from the operating unit 16, is monitored in block 103, where it is monitored as to whether the same falls below a preadjusted limit value. It is thus monitored as to whether, in addition to the standstill of the machine, the milling drum 12 is also disengaged from the ground. If the nominal milling depth continues to be greater than the limit value, it is monitored in the next step in block 104 as to whether a nominal speed greater than zero has been adjusted again, that is, whether the machine operator wishes to resume the working operation by increasing the speed. The steps 103 and 104 are performed continuously during the standstill of the machine until either the milling depth is changed, or the advance rate is increased again.

In addition, it may also be monitored in step 104 as to whether the nominal milling depth was increased by the machine operator, meaning whether the milling depth is to be increased while the machine is stationary.

If it is detected in block 104 that the nominal speed has now reached a value greater than zero again or that the nominal milling depth was increased, meaning that the machine operator wishes to move the construction machine forward again and/or to increase the milling depth, an intended continuation of the working operation is detected and the milling drum driven again in block 120. After the specified milling drum speed of revolution has been reached, the milling drum is lowered to the adjusted nominal milling depth in block 121, and the machine is driven via the travelling devices 8, 9 in block 122 until the actual speed corresponds to the nominal speed adjusted. Subsequently, monitoring is performed according to blocks 101 and 110 again as to whether the actual speed and/or actual milling depth change beyond the specified limit values.

If it is determined in block 110 that the milling depth is reduced below a specified limit value, an interruption of the working operation is also detected.

The drive of the milling drum is therefore interrupted in block 112. In the following, it is monitored in block 113 as to whether a nominal milling depth has been adjusted again which is greater than the specified limit value.

During this monitoring process, the actual and nominal speeds are not relevant as the road milling machine can be moved freely, for example, in manoeuvring mode while the milling drum is disengaged from the ground. If it was detected in the previously described block 103 that, with the drive of the milling drum already interrupted, the milling depth was reduced below the limit value and, as a consequence, the milling drum was disengaged from the ground, a jump is made to block 113 as the nominal and actual speeds do, in this case, also not have an influence on the detection of the continuation of the working operation.

If it is detected in block 113 that a nominal milling depth above the limit value has been adjusted, that is, the milling drum is to be engaged with the ground again, it is monitored in block 114 as to whether the machine is in reverse travel. If the machine is not in reverse travel, an intended continuation of the working operation has been detected, and the steps of blocks 120, 121, 122 are performed in accordance with the aforementioned description. If a reverse travel of the machine is detected in block 114, the steps 120-122 are not performed until a reverse travel of the machine can no longer be determined.

Figure 7:
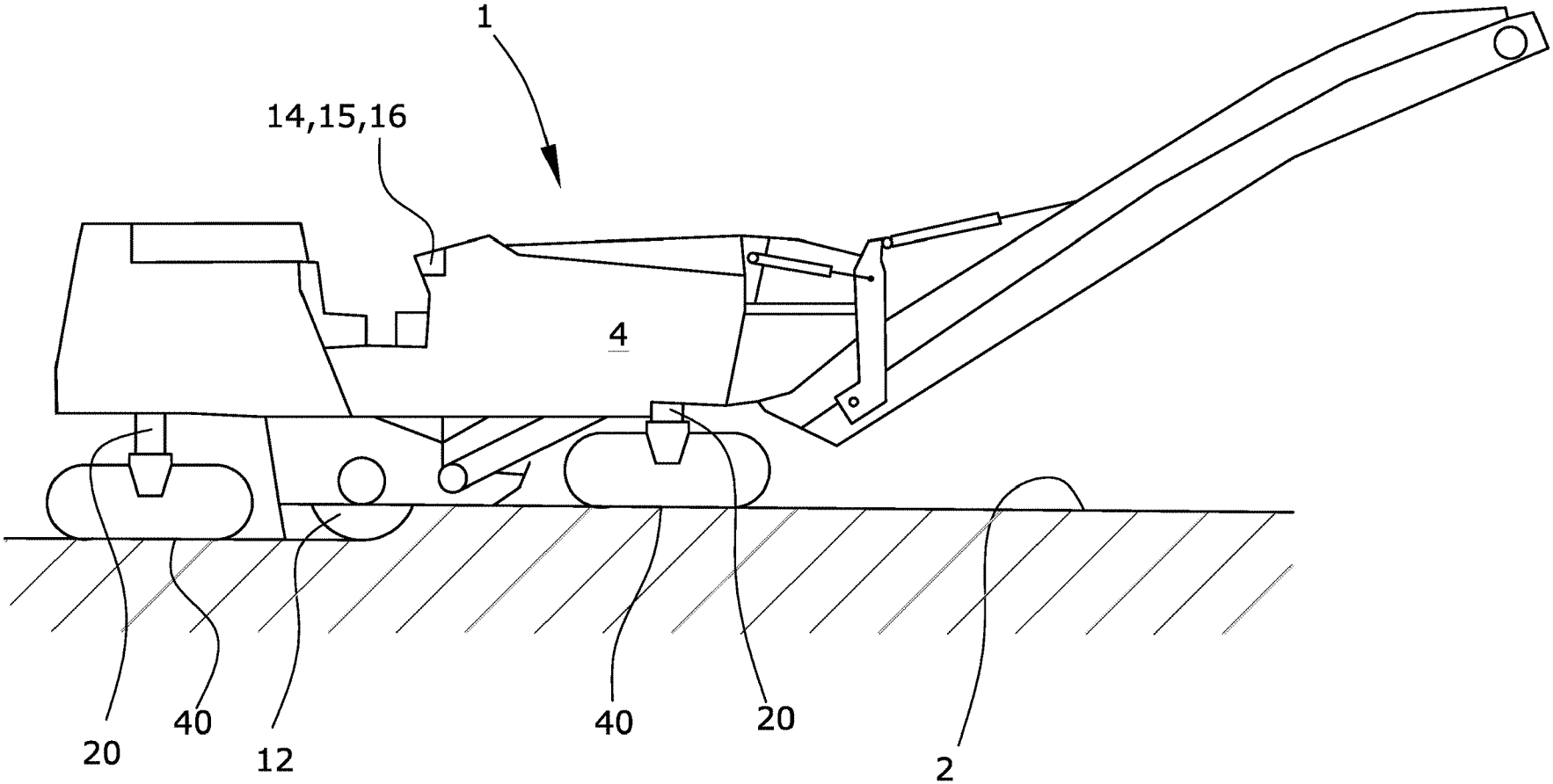
FIG. 7 shows a further self-propelled construction machine.

FIG. 7 shows a construction machine 1 as a so-called large milling machine which is different from the construction machine according to FIG. 1 in that, among other things, the front and rear travelling devices 40 are tracked ground-engaging units and the front as well as the rear travelling devices 40 are connected to the machine frame 4 via lifting columns. The detection of the interruption of the working operation or of the intended continuation of the working operation, respectively, is effected in an analogous fashion by means of monitoring the operating parameters.

The terms control device 14 and monitoring device 15 may be or comprise a multipurpose processor, a digital signal processor (DSP), an application-specific integrated circuit (ASIC), a field-programmable gate array (FPGA) or other programmable logic circuits, discrete gate or transistor logic, discrete hardware components, or a combination of the same, or may be part thereof, provided that they are programmable in order to perform the features described above.

A multipurpose processor may be a microprocessor, microcontroller, state machine, or a combination of computer devices, for example, a combination of a DSP and a microprocessor, a multitude of microprocessors, or any other type of known configuration.

The procedural steps of the method described above may be implemented directly through hardware components, or through a software module that is executed by a processor, or a combination thereof. The software module may be located on a RAM memory, a flash memory, a ROM memory, an EPROM memory, an EEPROM memory, a register, a hard disk, a removable hard disk, a CD-ROM, or any other type of computer-readable storage medium.

The computer-readable storage medium may be coupled with the control device and/or monitoring device so that the control device and/or the monitoring device can retrieve the information from the computer-readable storage medium and save information on the computer-readable storage medium. The computer-readable storage medium may alternatively also be an integral part of the control device and/or monitoring device. The control device and/or monitoring device and the computer-readable storage medium may be located in an ASIC. The ASIC may be located in a user terminal. Alternatively, the control device and/or monitoring device and/or the computer-readable storage medium may be located in a user terminal as discrete components.

The invention claimed is:

1. A self-propelled construction machine for working ground pavement, comprising:

at least one machine frame;

at least one height-adjustable milling drum configured to work the ground pavement in a working operation, driven by at least one drive unit;

at least one control device configured to monitor and control a milling depth of the milling drum and a speed of the construction machine; and a monitoring device configured to monitor adjustments to at least one nominal operating parameter of the construction machine, said nominal operating parameter effectively corresponding to an actual operating parameter of the construction machine, to detect an interruption of the working operation, and upon detection of the interruption of the working operation, to emit a signal to interrupt the drive of the milling drum via the drive unit.

2. The self-propelled construction machine of claim 1, wherein the monitoring device is configured to detect an interruption of the working operation by comparing the at least one monitored nominal operating parameter with at least one specified limit value.

3. The self-propelled construction machine of claim 2, wherein the at least one nominal operating parameter comprises a nominal advance speed, and an interruption of the working operation is detected when the nominal advance speed becomes zero.

4. The self-propelled construction machine of claim 2, wherein the at least one nominal operating parameter comprises a nominal milling depth, and an interruption of the working operation is detected when the nominal milling depth becomes negative.

5. The self-propelled construction machine of claim 1, comprising a power transmission device configured to transmit a driving power from the drive unit to the milling drum, and further configured responsive to the emitted signal from the monitoring device interrupt the drive of the milling drum.

6. The self-propelled construction machine of claim 1, wherein the monitoring device is configured to detect an interruption of the working operation and to emit the signal to interrupt the drive of the milling drum only after a specified time delay.

7. The self-propelled construction machine of claim 1, wherein the monitoring device is configured, following the interruption of the drive of the milling drum, to detect whether the working operation is to be continued, and upon detecting the intended continuation of the working operation to emit a second signal for the renewed driving of the milling drum.

8. The self-propelled construction machine of claim 7, wherein the monitoring device is configured to detect the intended continuation of the working operation by:

querying at least one operating parameter of the construction machine from the control device, and comparing the at least one operating parameter with at least one specified limit value.

9. The self-propelled construction machine of claim 1, wherein the control device is configured to delay one or more of the movement of the construction machine and a lowering of the milling drum until the milling drum has reached a specified operating speed of revolution.

10. A method for working ground pavements with a construction machine that is self-propelled via one or more travelling devices, and in which a milling drum is driven by a drive unit, wherein the milling drum works the ground pavement in a working operation, the method comprising:

monitoring adjustments to at least one nominal operating parameter of the construction machine, said nominal operating parameter effectively corresponding to an actual operating parameter of the construction machine, to automatically detect an interruption of the working operation; and upon detecting an interruption of the working operation, automatically interrupting the drive of the milling drum.

11. The method of claim 10, wherein detecting an interruption of the working operation comprises comparing the at least one monitored nominal operating parameter with at least one specified limit value.

12. The method of claim 11, wherein the at least one nominal operating parameter comprises a nominal advance speed, and an interruption of the working operation is detected when the nominal advance speed becomes zero.

13. The method of claim 11, wherein the at least one nominal operating parameter comprises a nominal milling depth, and an interruption of the working operation is detected when the nominal milling depth becomes negative.

14. The method of claim 10, wherein the drive of the milling drum is interrupted by one or more of decoupling the milling drum from the drive unit and switching off the drive unit.

15. The method of claim 14, wherein the drive of the milling drum is interrupted only after a specified time delay.

16. The method of claim 10, further comprising automatically detecting whether the working operation is to be continued, and upon detecting the intended continuation of the working operation to automatically resume driving of the milling drum.

17. The method of claim 16, wherein detecting an intended continuation of the working operation comprises:

querying at least one operating parameter of the construction machine, and comparing the at least one operating parameter with at least one specified limit value.

18. The method of claim 10, further comprising delaying one or more of the movement of the construction machine and a lowering of the milling drum until the milling drum has reached a specified operating speed of revolution.

* * * * *